US006549732B2

(12) United States Patent
Yoshizaki et al.

(10) Patent No.: US 6,549,732 B2
(45) Date of Patent: Apr. 15, 2003

(54) PROCESSING CARTRIDGE FOR IMAGE FORMING APPARATUS HAVING A NON-VOLATILE MEMORY

(75) Inventors: Yoshihiko Yoshizaki, Osaka (JP); Kazuo Okunishi, Osaka (JP); Hideki Hino, Osaka (JP); Kentaro Nagatani, Osaka (JP); Yoshiaki Takano, Osaka (JP); Daisetsu Tohyama, Osaka (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/906,083

(22) Filed: Jul. 17, 2001

(65) Prior Publication Data

US 2002/0021906 A1 Feb. 21, 2002

(30) Foreign Application Priority Data

Jul. 24, 2000 (JP) ..... 2000-222119
Jul. 24, 2000 (JP) ..... 2000-222130

(51) Int. Cl.[7] ..... G03G 15/00
(52) U.S. Cl. ..... 399/12; 399/25; 399/111
(58) Field of Search ..... 399/9, 12, 13, 399/24, 25, 26, 111

(56) References Cited

U.S. PATENT DOCUMENTS

| | | | | | |
|---|---|---|---|---|---|
| 5,406,606 | A | | 4/1995 | Sekiya | 377/28 |
| 5,452,059 | A | * | 9/1995 | Sekiya | 399/25 |
| 5,995,774 | A | * | 11/1999 | Applegate et al. | 399/27 |
| 6,144,812 | A | * | 11/2000 | Ueno | 399/12 |

FOREIGN PATENT DOCUMENTS

| | | | |
|---|---|---|---|
| EP | 0 699 978 A2 | | 3/1996 |
| JP | 07-64451 | * | 3/1995 |
| JP | 10-198236 | | 7/1998 |
| JP | 11-212407 | | 8/1999 |
| JP | 2000-19891 | | 1/2000 |
| JP | 2000-19929 | | 1/2000 |

* cited by examiner

*Primary Examiner*—Hoan Tran

(57) ABSTRACT

A process cartridge removably insertable in a body of an image-forming apparatus. The process cartridge has at least one constituent element executing an image formation process, and a non-volatile memory. In the non-volatile memory, data having an identical content are stored at a plurality of mutually spaced locations, the number of which depends on a kind of the data. With respect the locations for the data of an identical content, an address shift amount from one location to another is set according to the kind of the data.

14 Claims, 18 Drawing Sheets

*Fig. 8*

EEPROM MEMORY MAP

| ADDRESS | NAME OF DATA | INITIAL VALUE | KIND OF DATA |
|---|---|---|---|
| 0 | DETECTION OF INSERTION | A5A5h | REWRITABLE |
| 1 | DETECTION OF NEW PRODUCT | 0000h | REWRITABLE |
| 2 | SHIPMENT DESTINATION | 0000h | READ ONLY |
| 3 | OEM CODE | 0000h | READ ONLY |
| 4 | COLOR CODE | 0001h(C), 0002h(M) 0004h(Y), 0008h(K) | READ ONLY |
| 5.6.7.8.9 | LOT NO. | 0000000000000000000h | READ ONLY |
| 10 | NO. OF RECYCLES (RESERVATION NO. 1) | 0000h | READ ONLY |
| 11 | NO. OF RECYCLES (RESERVATION NO. 2) | 0000h | READ ONLY |
| 12 | NO. OF RECYCLES (RESERVATION NO. 3) | 0000h | READ ONLY |
| 13 | NO. OF RECYCLES (RESERVATION NO. 4) | 0000h | READ ONLY |
| 14 | NO. OF RECYCLES (RESERVATION NO. 5) | 0000h | READ ONLY |
| 15 | (UNDEFINED) | 0080h | - |
| 16 | (UNDEFINED) | 0080h | - |
| 17 | (UNDEFINED) | 0080h | - |
| 18 | (UNDEFINED) | 0080h | - |
| 19 | (UNDEFINED) | 0080h | - |
| 20 | (UNDEFINED) | 0080h | - |
| 21 | TC HISTORY | 00000000h | REWRITABLE |
| 22 | ATDC SENSOR OFF-SET VALUE | 00000000h | REWRITABLE |
| 23.24 | DEVELOPING ROLLER COUNTER | 0000h | REWRITABLE |
| 25.26 | PHOTOSENSITIVE DRUM COUNTER | 0000h | REWRITABLE |
| 27 – 39 | (UNDEFINED) | - | - |
| 40 | DETECTION OF INSERTION | A5A5h | REWRITABLE |
| 41 | DETECTION OF NEW PRODUCT | 0000h | REWRITABLE |
| 42 – 47 | (UNDEFINED) | - | - |
| 48.49 | DEVELOPING ROLLER COUNTER | 00000000h | REWRITABLE |
| 50.51 | PHOTOSENSITIVE DRUM COUNTER | 00000000h | REWRITABLE |
| 52 | (UNDEFINED) | - | - |
| 53 – 58 | (UNDEFINED) | - | - |
| 59.60 | DEVELOPING ROLLER COUNTER | 00000000h | REWRITABLE |
| 61.62 | PHOTOSENSITIVE DRUM COUNTER | 00000000h | REWRITABLE |

*Fig. 9*

| NUMBER OF MEMORY LOCATIONS | NAME OF DATA | KIND OF DATA |
|---|---|---|
| 3 | DEVELOPING ROLLER COUNTER<br>PHOTOSENSITIVE DRUM COUNTER | REWRITABLE |
| 2 | DETECTION OF INSERTION<br>DETECTION OF NEW PRODUCT | |
| 1 | TC HISTORY<br>ATDC SENSOR OFF-SET VALUE | |
| 1 | SHIPMENT DESTINATION<br>OEM CODE<br>COLOR CODE<br>LOT NO.<br>NO. OF RECYCLES (RESERVATION NO. 1)<br>NO. OF RECYCLES (RESERVATION NO. 2)<br>NO. OF RECYCLES (RESERVATION NO. 3)<br>NO. OF RECYCLES (RESERVATION NO. 4)<br>NO. OF RECYCLES (RESERVATION NO. 5) | READ ONLY |

*Fig. 16*

EEPROM MEMORY MAP

| ADDRESS | NAME OF DATA | INITIAL VALUE | KIND OF DATA |
|---|---|---|---|
| 0 | DETECTION OF INSERTION | A5A5h | REWRITABLE |
| 1 | SHIPMENT DESTINATION | 0000h | READ ONLY |
| 2 | OEM CODE | 0000h | READ ONLY |
| 3 | COLOR CODE | 0001h(C), 0002h(M) 0004h(Y), 0008h(K) | READ ONLY |
| 4 | DETECTION OF NEW PRODUCT | 0000h | REWRITABLE |
| 5.6.7.8.9 | LOT NO. | 00000000000000000000h | READ ONLY |
| 10 | NO. OF RECYCLES (RESERVATION NO. 1) | 0000h | READ ONLY |
| 11 | NO. OF RECYCLES (RESERVATION NO. 2) | 0000h | READ ONLY |
| 12 | NO. OF RECYCLES (RESERVATION NO. 3) | 0000h | READ ONLY |
| 13 | NO. OF RECYCLES (RESERVATION NO. 4) | 0000h | READ ONLY |
| 14 | NO. OF RECYCLES (RESERVATION NO. 5) | 0000h | READ ONLY |
| 15 | (UNDEFINED) | 0080h | - |
| 16 | (UNDEFINED) | 0080h | - |
| 17 | (UNDEFINED) | 0080h | - |
| 18 | (UNDEFINED) | 0080h | - |
| 19 | (UNDEFINED) | 0080h | - |
| 20 | (UNDEFINED) | 0080h | - |
| 21 | TC HISTORY | 00000000h | REWRITABLE |
| 22 | ATDC SENSOR OFF-SET VALUE | 00000000h | REWRITABLE |
| 23.24 | DEVELOPING ROLLER COUNTER | 0000h | REWRITABLE |
| 25.26 | PHOTOSENSITIVE DRUM COUNTER | 0000h | REWRITABLE |
| 27 – 39 | (UNDEFINED) | - | - |
| 40 | DETECTION OF INSERTION | A5A5h | REWRITABLE |
| 41 | DETECTION OF NEW PRODUCT | 0000h | REWRITABLE |
| 42 – 47 | (UNDEFINED) | - | - |
| 48.49 | DEVELOPING ROLLER COUNTER | 00000000h | REWRITABLE |
| 50.51 | PHOTOSENSITIVE DRUM COUNTER | 00000000h | REWRITABLE |
| 52 | (UNDEFINED) | - | - |
| 53 – 58 | (UNDEFINED) | - | - |
| 59.60 | DEVELOPING ROLLER COUNTER | 00000000h | REWRITABLE |
| 61.62 | PHOTOSENSITIVE DRUM COUNTER | 00000000h | REWRITABLE |

PROCESSING CARTRIDGE FOR IMAGE FORMING APPARATUS HAVING A NON-VOLATILE MEMORY

This application is based on applications Nos. 2000-222119 and 2000-222130 filed in Japan, the entire content of which is hereby incorporated by reference.

BACKGROUND OF THE INVENTION

The present invention relates to process cartridge removably insertable in a body of an image-forming apparatus and having constituent elements executing an image formation process and a non-volatile memory storing given information in association with addresses.

In recent years, process cartridges removably insertable in the body of an image-forming apparatus have come into popular use to recycle natural resource as a main purpose. Some process cartridges of this kind have a non-volatile memory storing information about the respective process cartridges, in addition to constituent parts necessary for performing a known electrophotographic process which include a photosensitive drum, a charging unit, an exposing unit, a developing unit, a cleaner, and a toner reservoir.

FIG. 6 of Japanese Patent Application Laid-open No. 2000-19929 shows a memory map of an EEPROM (electrically erasable programmable read only memory) which is a non-volatile memory included in a process cartridge. As apparent from the memory map, data of the same content are stored at a plurality of addresses spaced apart from each other to enhance reliability in data recording. Further, because the amount of shift ("address shift amount") between adjacent locations storing the same data is constant (32 in the above-mentioned memory map), it is possible to simplify an access program for storing and reading data.

However, the aforementioned constant address shift amount invites a useless increase of usage of addresses, resulting in low storage efficiency. This is inconvenient to the process cartridge because it is difficult to load a memory having a large capacity thereon and also from the viewpoint of costs.

SUMMARY OF THE INVENTION

Therefore, it is an object of the present invention to provide a process cartridge having a non-volatile memory storing various data with a preferable data arrangement free from the above-described disadvantages.

Generally, rewritable data is susceptible to errors accompanying a write operation, while read-only data not only is at low risk of errors because of being subject to no write operation, but also has a low degree of importance or significance. In view of this, according to an aspect of the present invention, there is provided a process cartridge removably insertable in a body of an image-forming apparatus, comprising:

- a constituent element executing an image formation process; and
- a non-volatile memory storing rewritable data having an identical content at a plurality of mutually spaced locations, and each of read-only data (e.g., data indicating a kind of the process cartridge) at locations equal in number to or fewer than the locations for a rewritable data which is assigned a fewest number of locations among all the rewritable data.

The rewritable data may include a counter data that represents a value counted when an image formation process is performed using the process cartridge. The rewritable data may further a detection-of-insertion data indicating whether the process cartridge has been inserted in the body of the image-forming apparatus, and/or a detection-of-new-product data indicating whether the process cartridge is new. The number of locations in the non-volatile memory for the detection-of-insertion data and that for the detection-of-new-product data can be smaller than that for the counter data because both the detection-of-insertion data and the detection-of-new-product data would be read less frequently than the counter data and thus are less susceptible to errors than the counter data.

According to another aspect of the present invention, there is provided a process cartridge removably insertable in a body of an image-forming apparatus, comprising:

- a constituent element executing an image formation process; and
- a non-volatile memory storing data having an identical content at a plurality of mutually spaced locations in address shift amounts set according to a kind of the data.

Storing one data at a plurality of spaced locations allows another data to be stored between the locations. Thus, it is unlikely that the same data stored at the different locations are simultaneously destroyed. Also, because, with respect the locations for the data of an identical content, an address shift amount from one location to another is set according to the kind of the data, the storage efficiency of the non-volatile memory is increased.

In one embodiment, the address shift amounts are different among a plurality of data that are assigned different numbers of locations in the non-volatile memory. On the other hand the address shift amounts are the same among a plurality of data that are assigned the same number of locations in the non-volatile memory.

In the non-volatile memory, data assigned a single location may be stored at an address prior to an address of a second one of the locations for the data having an identical content. Then, even if the process cartridge is inserted in a test machine in which no rules regarding the data arrangement of the non-volatile memory of the process cartridge are installed, the machine can read out all kinds of data stored in the non-volatile memory before reaching the second location of any of data assigned a plurality of locations merely by sequentially accessing the memory from the headmost address. Thus, the non-volatile memory can be accessed with a simpler control.

According to a further aspect of the present invention, there is provided a process cartridge removably insertable in a body of an image-forming apparatus, comprising:

- at least one constituent element executing an image formation process; and
- a non-volatile memory sequentially storing, from a headmost address thereof, a detection-of-insertion data indicating whether the process cartridge has been inserted in the body of the image-forming apparatus, a destination data indicating a destination of the process cartridge, and a color code data indicating a color of an image which is formed by the process cartridge.

The process cartridge having the non-volatile memory with such data arrangement allows a control system on the side of the image-forming apparatus body to access the non-volatile memory so as to sequentially read data from the headmost address as follows. First, the control system reads the detection-of-insertion data to determine whether the process cartridge is present in the body of the image-forming apparatus. If it is present, the control system reads the destination data next to determine whether the designated destination of the process cartridge is coincident with a destination data of the image-forming apparatus's own. The determination result indicates whether the process cartridge matches the body of the image-forming apparatus. If the process cartridge is determined to match the body of the image-forming apparatus, then the control system reads the color code data to determine whether the process cartridge is placed in position in the image-forming apparatus body (for example, in a station for a color matching the process cartridge). Only after the process cartridge is determined to be in position in the image-forming apparatus body, it is determined that the process cartridge has been properly inserted in the body of the image-forming apparatus. Thereafter, the control system of the image-forming apparatus is allowed to start various control operations for image formation using the process cartridge.

As can be understood from the above, the control system of the image-forming apparatus side is not required to have a table storing the order of access to addresses of the non-volatile memory, but is allowed to access sequentially the addresses of the non-volatile memory from the headmost one. Thus, this data arrangement in the non-volatile memory contributes to simplification of the control by the control system of the image-forming apparatus body regarding the access thereto. This is true also when the process cartridge is inserted in a test machine before its shipment or after its recovery or return.

To have the destination of the process cartridge checked in detail, the destination data may include, in order of address, a shipment destination data indicating a destination classified by region and an OEM code data indicating an OEM for which the process cartridge has been manufactured.

Generally, a density adjustment for the process cartridge is required to precede the other controls for the image formation operation to achieve color balance with other process cartridges placed in the body of the image-forming apparatus. To satisfy the requirement, in one embodiment, the non-volatile memory contains a detection-of-new-product data indicating whether the process cartridge is new at an address subsequent to the address at which the color code data is stored. The control system of the image-forming apparatus will read the color code data only after determining the non-volatile memory has been properly inserted but before starting the control for the image formation operation using the process cartridge. When determining that the process cartridge is new, the control system is allowed to perform a density adjustment operation for the process cartridge before starting the control for the image formation using the process cartridge.

To facilitate production of the process cartridge, the at least one constituent element of the process cartridge may include a photosensitive unit including a photosensitive drum, a charging device, and a cleaner, and a developing unit including a developing device and a toner reservoir.

Other objects, features and advantages of the present invention will be obvious from the following description.

BRIEF DESCRIPTION OF THE DRAWINGS

The present invention will become more fully understood from the detailed description given hereinbelow and the accompanying drawings which are given by way of illustration only, and thus are not limitative of the present invention, and therein:

FIG. 8 shows an example of a memory map of the EEPROM;

FIG. 9 shows the number of locations for each data depending on the number of accesses and a degree of importance;

FIG. 16 shows another example of the memory map of the EEPROM;

DETAILED DESCRIPTION OF THE PREFERRED EMBODIMENTS

Figure 1:
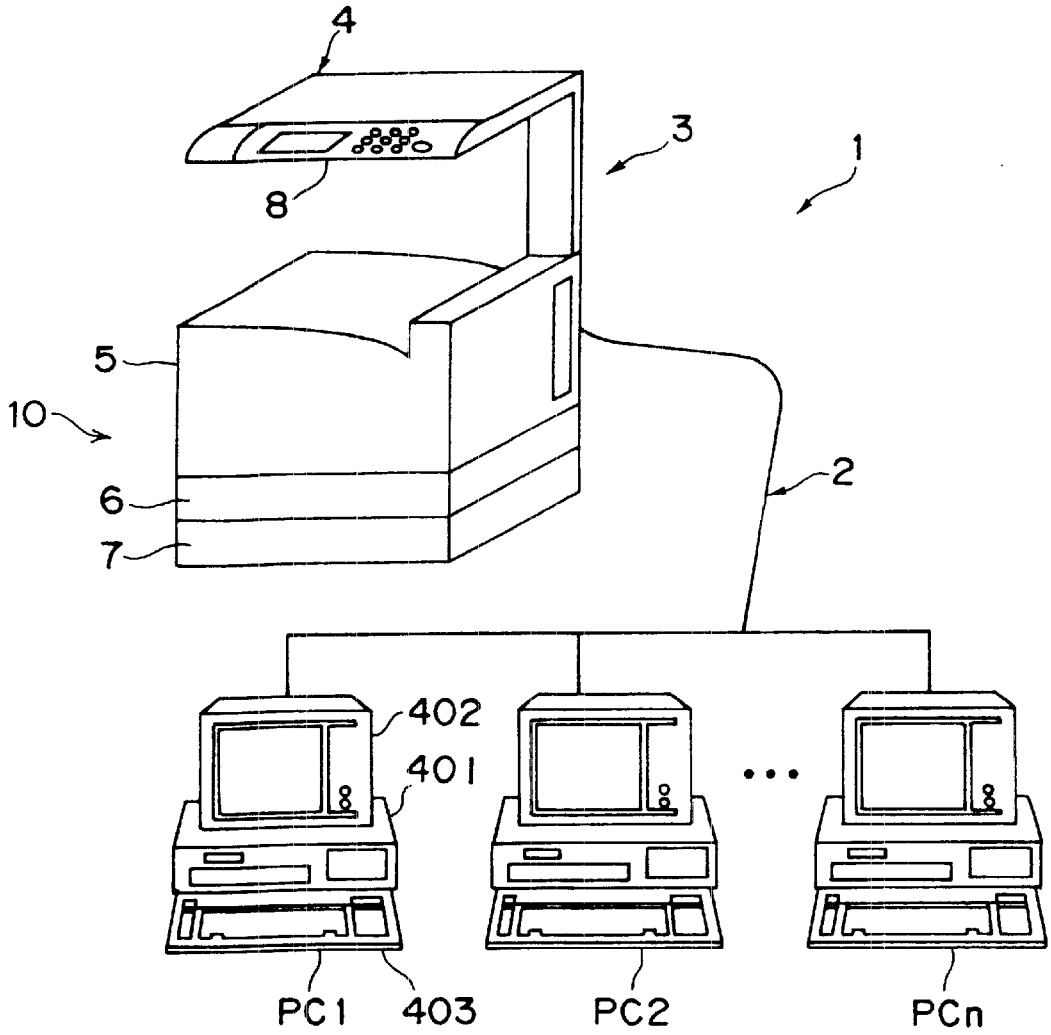
FIG. 1 shows the entire construction of a printer system including a printer in which a process cartridge according to an embodiment of the present invention is installed.

FIG. 1 shows the entire construction of a printer system 1 including a printer 3 into which a process cartridge of an embodiment of the present invention has been inserted. The printer system 1 has a LAN (local area network) 2, and a plurality of terminals PC1–PCn and the printer 3 connected to the LAN 2.

Each of the terminals PC1–PCn has a personal computer main unit 401 having a hard disk and the like, and a monitor display 402 and a key board 403 connected to the main unit 401. Installed on the hard disk are an OS (operating system) compatible with the LAN 2, a printer driver, an application software for forming a document, and the like.

When a document produced by using the application software is printed out by a printer 3, image data (printing data) such as document data and information on a size of paper on which the document or the like is printed (i.e., paper size information) are sent to the printer 3 through the LAN 2.

The printer 3 has a scanning part 4 reading the image of an original document and a printing part 10 forming an image, based on image data of the original document read by the scanning part 4 or print data sent from the terminals PC1–PCn through the LAN 2.

The scanning part 4 is of a known type. That is, in the scanning part 4, light is emitted to the original document by a light source. A CCD image sensor photoelectrically converts light reflected from the original document to obtain an electrical signal. The thus obtained electrical signal is converted to image data by a controller 25 (see FIG. 6) of the printing part 10.

The printing part 10 adopts an electrophotographic method to form an image on paper. In the embodiment, the printing part 10 has a printer body 5, a paper feed cassette 6 accommodating paper sheets of size A4 and a paper feed cassette 7 accommodating paper sheets of size B4. Each of the paper feed cassettes 6 and 7 is provided with a paper detection sensor (not shown). A detection signal is transmitted from the paper detection sensor to the controller 25. Based on the detection signal, the controller 25 determines whether paper sheets are set in the paper feed cassettes 6 and 7.

Figure 2:
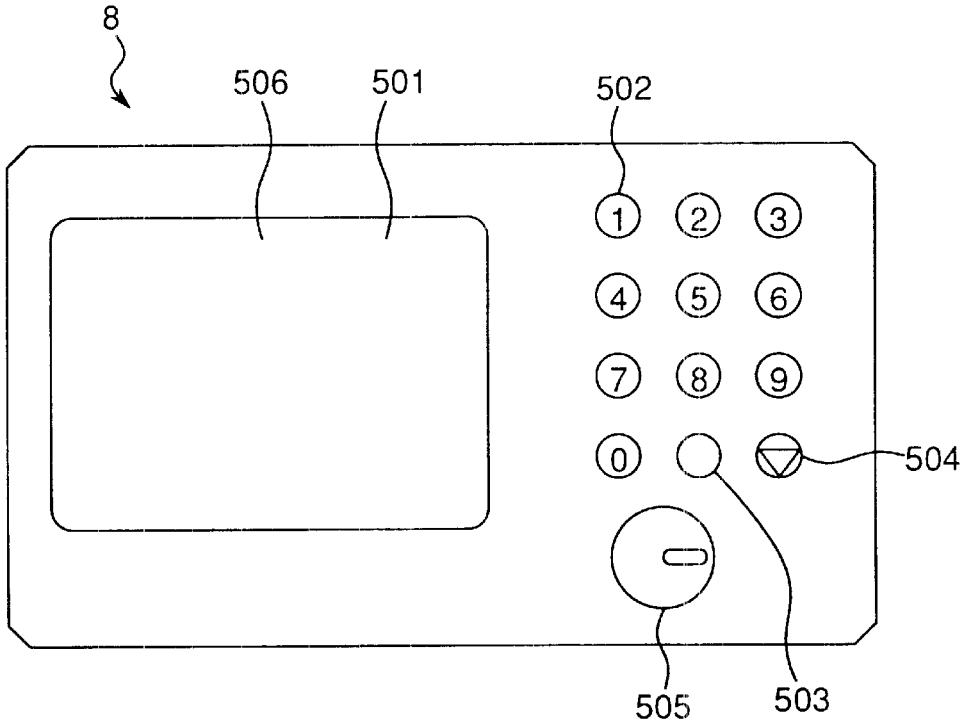
FIG. 2 shows an operation panel of the printer.

An operation panel 8 is disposed at an easy-to-operate position of a front of the scanning part 4. As shown in FIG. 2, the operation panel 8 has a liquid crystal display 501 and a touch panel 506 made of a transparent material and disposed on the liquid crystal display 501. The liquid crystal display 501 displays an operation mode of the printer 3 and the state of the inside thereof. The touch panel 506 has pressure-sensitive switches. By using the touch panel 506 in combination with the liquid crystal display 501, a user can input a printing operation mode and the like. The operation panel 8 has a ten-key numerical pad 502 for inputting numerical values such as the number of printings, a printing magnification, and the like, a start key 505 for indicating the start of a printing operation, a clear key for clearing the printing operation mode set by the user, and a stop key 504 for suspending a printing operation of the printer 3.

Figure 3:
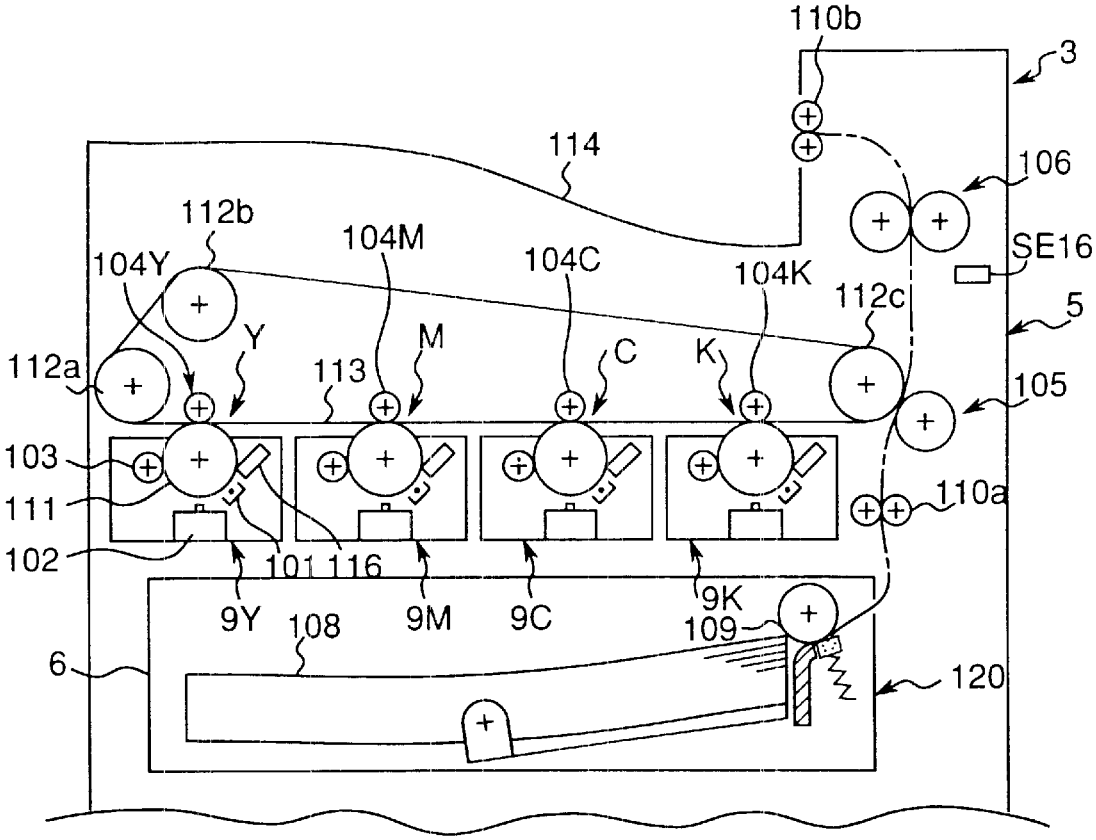
FIG. 3 is a sectional view of the printer.

As shown in FIG. 3, the printer 3 has process cartridges 9Y, 9M, 9C, and 9K removably mounted on image-forming stations Y (yellow), M (magenta), C (cyan), and K (black) respectively disposed at approximately the center of the printer body 5. As constituent elements for forming an image, each of the process cartridges 9Y, 9M, 9C, and 9K includes a photosensitive drum 111, a charging unit 101, an exposing unit 102 having a light emitting diode (LED), a developing unit 103, and a cleaner 115 for cleaning the surface of the photosensitive drum 111 all disposed on the periphery of the photosensitive drum 111. Also, the process cartridges 9Y, 9M, 9C, and 9K each include a toner reservoir (not shown) for supplying toner of yellow, magenta, cyan, and black to their respective developing units 103. An ATDC (automatic toner density controller) sensor (not shown) which detects a toner density to automatically adjust a toner density in the toner reservoir is integrally mounted on the developing unit 103 of each of the process cartridges 9Y, 9M, 9C, and 9K. The photosensitive drums 111 of the process cartridges 9Y, 9M, 9C, and 9K confront corresponding primary transfer rollers 104Y, 104M, 104C, and 104K with the interposition of an intermediate transfer belt 113 supported by rollers 112*a*, 112*b*, and 112*c*.

A paper feed/conveyance portion 120 is disposed in a lower position of the printer body 5. In the paper feed/conveyance portion 120, a paper-feed roller 109 feeds sheets 108 accommodated in the paper feed cassette 6 (for convenience' sake, the paper feed cassette 7 is not shown in FIG. 3) one by one to convey the sheets to a secondary transfer roller 105 through a conveying roller 110*a*.

In each of the image-forming stations Y, M, C, and K, the charging unit 101 electrifies the surface of the photosensitive drum 111 uniformly. Then, based on the image data, the light emitting diode (LED) emits light to form an electrostatic latent image on the photosensitive drum 111. The developing unit 103 attaches toner supplied from the toner reservoir to the electrostatic latent image formed on the photosensitive drum 111 to form (develop) a toner image. The primary transfer portion 104 primarily transfers the toner image formed on the photosensitive drum 111 to the intermediate transfer belt 113 moved by the rollers 112*a*, 112*b*, and 112*c*. The secondary transfer roller 105 secondarily transfers the toner image on the intermediate transfer belt 113 to the paper 108 fed by the conveying roller 110*a*. The paper 108 to which the toner image has been transferred is fed to a fixation/ejection portion 106 disposed in an upper position of the printer body 5.

The fixture/ejection portion 106 fixes the toner image onto the paper 108. Then, through a conveying roller 110*b*, the fixture/ejection portion 106 ejects the toner image-fixed paper (print) to a discharge tray 114 disposed on the upper surface of the printer body 5.

The printer body 5 has an unshown front cover, which intercepts the user from at least the process cartridges 9Y, 9M, 9C, and 9K. A sensor SE 16 detects whether the front cover is open or closed.

Figure 4:
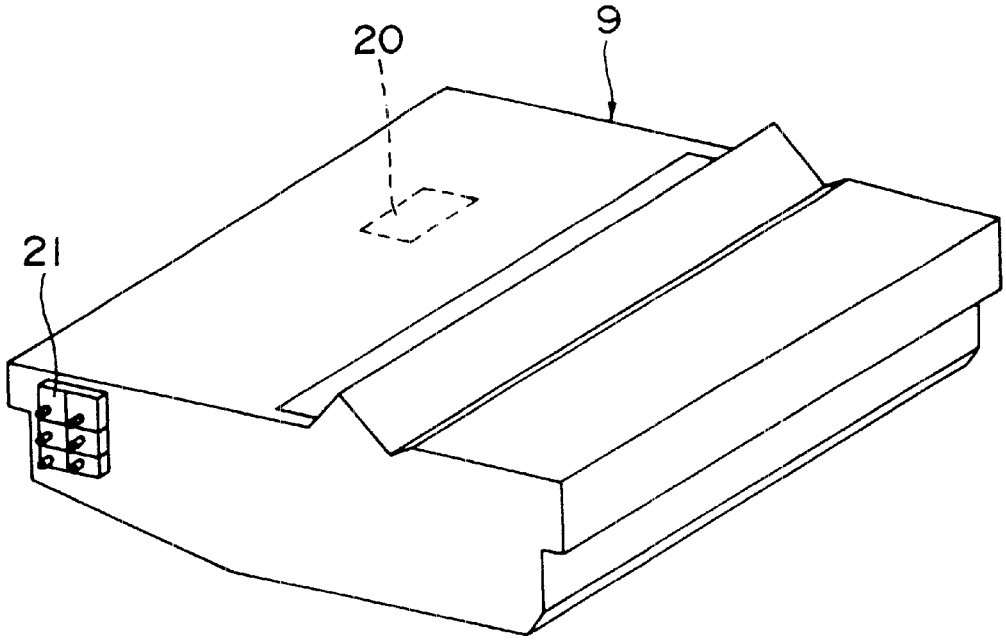
FIG. 4 is a perspective view of the process cartridge.
Figure 5:
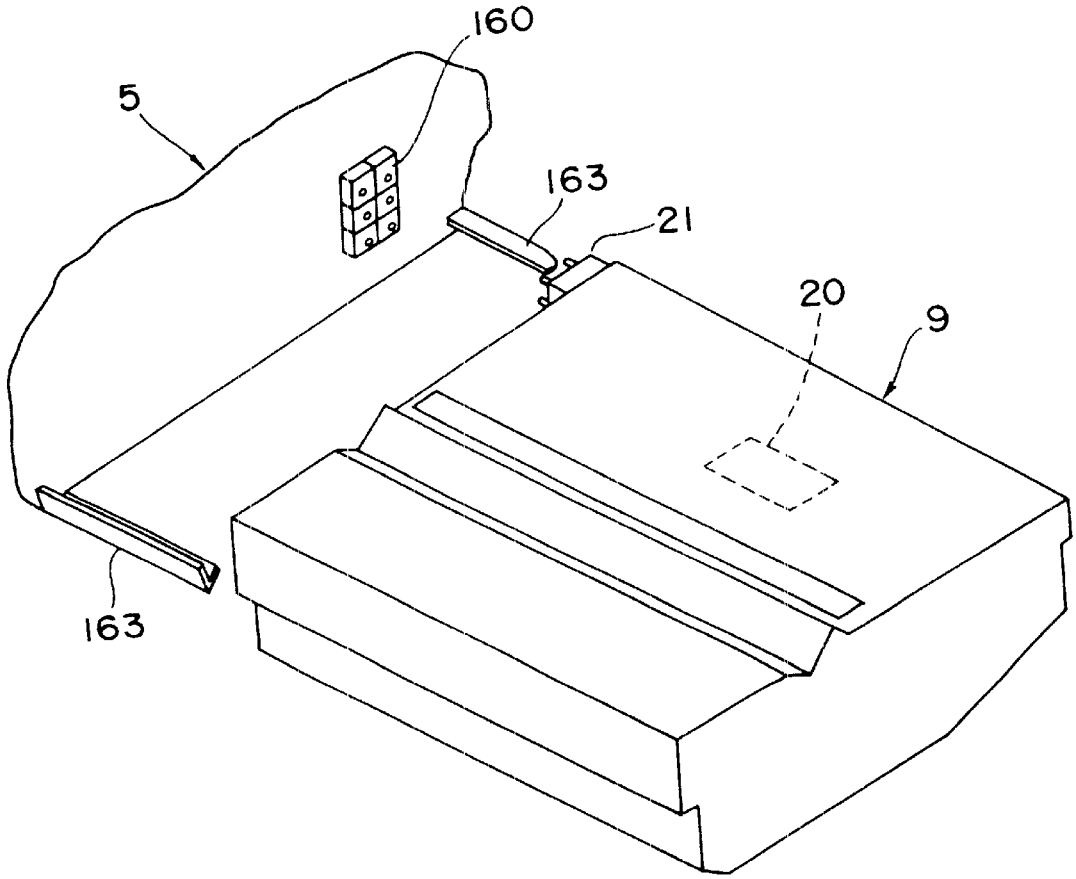
FIG. 5 shows a method of inserting the process cartridge into a printer body.

FIG. 4 is a perspective view of the process cartridge 9 (representing 9Y, 9M, 9C, and 9K). The process cartridge 9 is made by integrating the photosensitive drum 111, the charging unit 101, the exposing unit 102, the developing unit 103, and the cleaner 116 shown in FIG. 3 as one unit. The process cartridge 9 incorporates an EEPROM (electrically erasable programmable read only memory) 20 which is a non-volatile memory. Also, a data transfer connector 21 is disposed on an end surface of the process cartridge 9. In inserting the process cartridge 9 in the printer body 5, the process cartridge 9 is slid in along guide members 163 formed inside the printer body 5 until the connector 21 of the process cartridge 9 is connected to an associated connector 160 of the printer body 5, as shown in FIG. 5.

Figure 6:
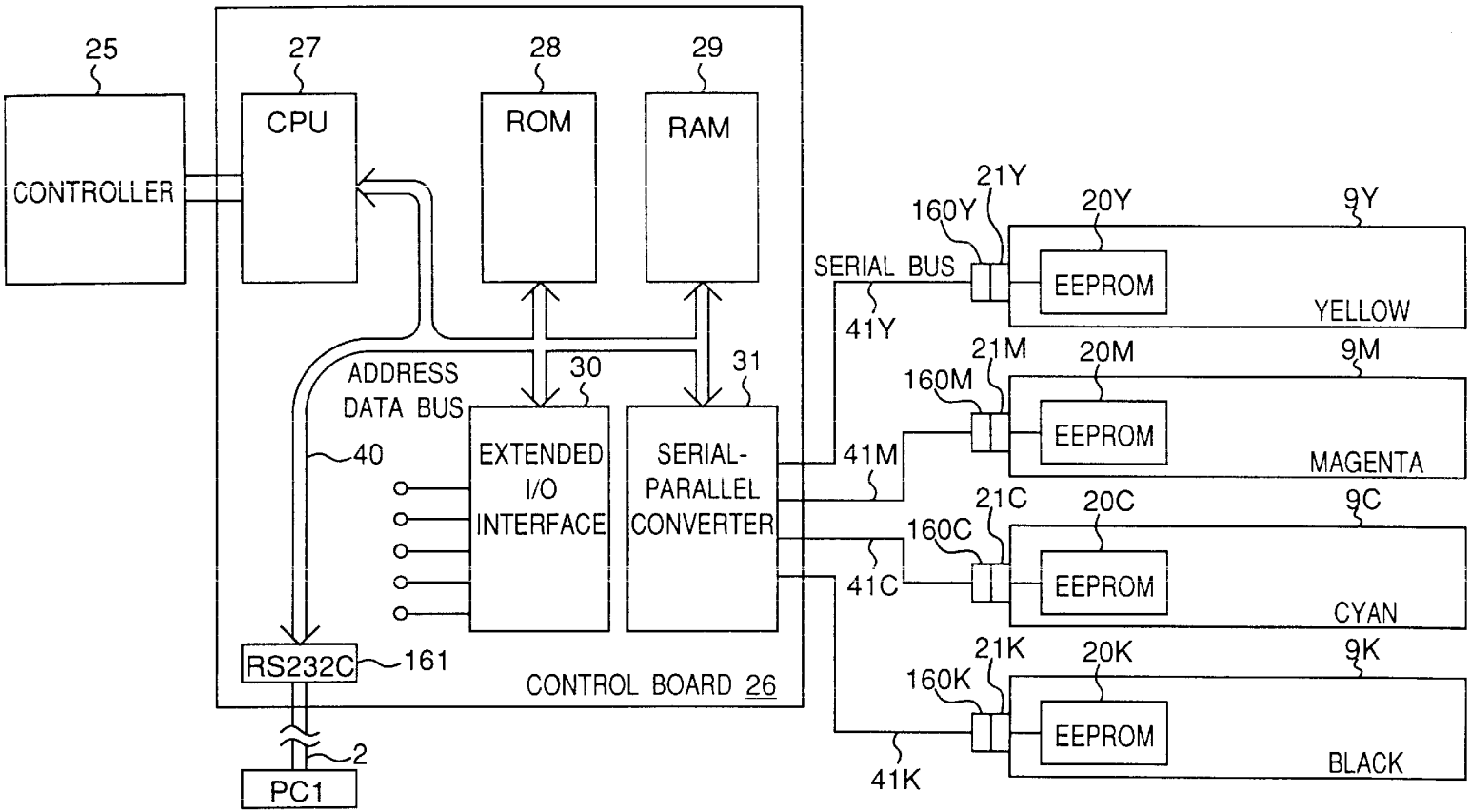
FIG. 6 schematically illustrates the construction of a control system of the printer, with process cartridges of different colors inserted in the printer body.

FIG. 6 illustrates the construction of the control system of the printer 3, with the process cartridges 9Y, 9M, 9C, and 9K installed in the printer body 5. Connectors 21Y, 21M, 21C, and 21K (corresponding to 21 of FIG. 5) of the process cartridges 9Y, 9M, 9C, and 9K are connected to corresponding connectors 160Y, 160M, 160C, and 160K (corresponding to 160 of FIG. 5) of the printer body 5 respectively.

The printer 3 has a controller 25 for controlling the operation of the entire printer and a control board 26 for controlling the process cartridges 9Y, 9M, 9C, and 9K. The control board 26 includes a CPU (central processing unit) 27, a ROM (read only memory) 28, a RAM (random access memory) 29, an extended I/O (input/output) interface 30, and a serial-parallel converter 31. The CPU 27, the ROM 28, the RAM 29, the extended I/O interface 30, and the serial-parallel converter 31 execute data communication with one another through an address data bus 40. The CPU 27 executes data communication with the controller 25 to perform printing processing. Through serial buses 41Y, 41M, 41C, and 41M, the serial-parallel converter 31 of the control board 26 executes data communication with the EEPROMs 20Y, 20M, 20C, and 20K (corresponding to 20 in FIG. 5) of the process cartridges 9Y, 9M, 9C, and 9K respectively. The control board 26 is connected to the LAN 2 through an RS232C interface 161. Thereby data communication is executed between the control board 26 and the terminals (for convenience' sake, only PC1 is shown in FIG. 6) through the LAN 2 to display information of the EEPROM 20 on a monitor display 402 of the terminal PC1.

Figure 7:
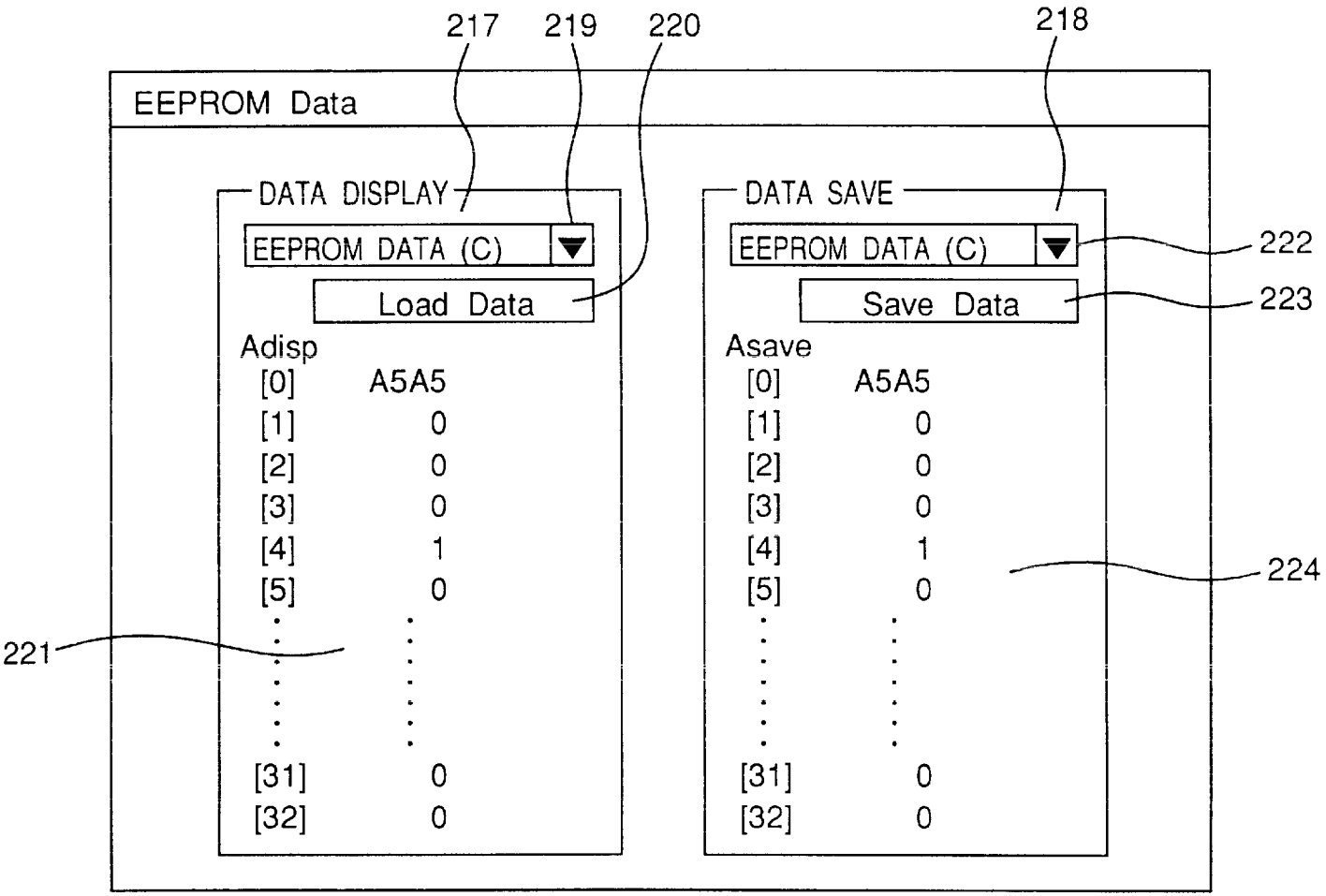
FIG. 7 shows an example of display, on a monitor of a terminal, of data read from an EEPROM and data stored therein.

FIG. 7 shows an example of display on the monitor display 402 of the terminal PC1 of data read from the EEPROM and data stored therein when data communication is executed between the control board 26 and the terminal PC1 through the LAN 2.

In the display example, a data display section 217 and a data save section 218 are displayed. The data display section 217 has an EEPROM selection drop-down list 219 with which the user can select a data display-desired EEPROM 20 from among the EEPROMs 20Y, 20M, 20C, and 20K, a "Load Data" button 220 for reading the data from the selected EEPROM 20, and a data display region 221 in which read data is displayed. The data save section 218 has an EEPROM selection drop-down list 222 with which the user can select a data storage-desired EEPROM 20 from among the EEPROMs 20Y, 20M, 20C, and 20K, a "Save Data" button 223 for saving the data of the selected EEPROM 20 in a file, and a data display region 224 in which saved data is displayed.

In displaying the data stored in the EEPROM 20 in the data display region 221, the user develops the EEPROM selection drop-down list 219 to select a data-display-desired EEPROM 20 from among the EEPROMs 20Y, 20M, 20C, and 20K. Thereafter, the "Load Data" button 220 is pressed to read the data of the EEPROM 20 and display the read data in the data display region 221.

In saving data in any one of the EEPROMs 20Y, 20M, 20C, and 20K, the user develops the EEPROM selection drop-down list 222 to select the data-storage-desired EEPROM 20 from among the EEPROMs 20Y, 20M, 20C, and 20K. Thereafter, the "Save Data" button 223 is pressed to save data in the file and display the stored data in the data display region 224. By viewing the display, the user can easily confirm the content of the data stored in the EEPROM 20.

The data display regions 221 and 224 have display locations having addresses Adisp and Asave from 0 to 32 respectively. The addresses Adisp and Asave correspond to addresses of the EEPROM 20. That is, data read from the EEPROM 20 and data to be stored therein are displayed in the display locations of the data display regions 221 and 224 respectively in order of address of the EEPROM 20.

FIG. 8 shows an example of a memory map of the EEPROM 20 incorporated in each process cartridge 9. In a table shown in FIG. 8, the column name "ADDRESS" indicates an address in which data is stored with two bytes forming one word, "NAME OF DATA" indicates a name of data to be stored (or having been stored), "INITIAL VALUE" indicates a value to be stored at the time of shipment from the factory, "KIND OF DATA" indicates whether data to be stored (or having been stored) is read only data or rewritable data.

As apparent from the memory map, stored data is classified into the read only data such as data named "color code" and "lot No." and the rewritable data such as data named "developing roller counter" and "photosensitive drum counter".

"Detection of insertion" data indicates whether the process cartridge 9 has been inserted in the printer body 5. "Detection of new product" data indicates whether the process cartridge 9 is new. "Shipment destination" data indicates a region of destination such as Japan, North America, and the like to which the process cartridge 9 is shipped. "OEM code" data indicates an OEM (original equipment manufacturer) for which the process cartridge 9 has been manufactured. That is, the "OEM code" data indicates a purchaser of the process cartridge 9 under whose brand name the process cartridge 9 is sold. "Color code" data indicates a color (yellow, magenta, cyan or black) of an image formed by the process cartridge 9. "Lot No." data indicates a lot number of the process cartridge 9. Each of "number of recycles" data indicates the reserved number of recycles of the process cartridge 9. "TC history" data indicates the history of the ratio of toner to carrier in the developing unit 103 of the process cartridge 9. "ATDC sensor off-set value" data indicates a control amount with respect to the output of an ATDC sensor for the developing unit 103 of the process cartridge 9. "Developing roller counter" data indicates the number of uses of the developing unit 103 of the process cartridge 9. "Photosensitive drum counter" data indicates the number of uses of the photosensitive drum 111 of the process cartridge 9.

The read only data having the same content is not stored at a plurality of addresses of the memory, but at one address. On the other hand, the rewritable data having the same content is stored at a plurality of addresses of the memory spaced apart from each other, according to the number of accesses and a degree of importance. In the case where data is stored in consecutive addresses, the data is regarded as being stored in one location. The data is stored according to the following rule.

(a) Same data having a large number of accesses and a high degree of importance is stored at three locations spaced apart from each other. For example, the value of the "developing roller counter" is stored at three locations of addresses 23–24, addresses 48–49, and addresses 59–60. Similarly, the value of the "photosensitive drum counter" is stored at three locations of addresses 25–26, addresses 50–51, and addresses 61–62.

(b) Same data having average number of accesses and an average degree of importance is stored at two locations spaced apart from each other. For example, the result of the "detection of insertion" is stored at two locations of an address 0 and an address 40. Similarly, the result of the "detection of new product" is stored at an address 1 and an address 41.

(c) Same data having a small number of accesses and a low degree of importance is stored at one location. For example, the "TC history" is stored only at one location of address 21. Similarly, the "ATDC sensor off-set value" data is stored only at address 22.

FIG. 9 shows a table listing the number of memory locations for each data in accordance with the number of accesses and the degree of importance, based on the rules (a)–(c).

According to the rules (a)–(c), data are efficiently arranged in the EEPROM 20 according to an error generation frequency and a degree of importance. Consequently, the EEPROM 20 has a preferable data arrangement.

(d) Among a plurality of different data that are each stored at the same number of locations spaced apart from each other, the address shift amounts thereof are the same. For example, for the "developing roller counter" data and the "photosensitive drum counter" data which are stored at three locations respectively, the address shift amounts of the second locations (addresses 48–49, addresses 50–51) with respect to the first locations (addresses 23–24, addresses 25–26) are equally 25, and the address shift amounts of the third locations (addresses 59–60, addresses 61–62) with respect to the second locations (addresses 48–49, addresses 50–51) are equally 11. For the "detection of insertion" data and the "detection of new product" data which are stored at two memory locations respectively, the address shift amounts of the second locations (address 40, address 41) with respect to the first locations (address 0, address 1) are equally 40.

(e) Among data for which the numbers of locations are different, the address shift amounts thereof are different from each other. For example, for the "developing roller counter" data and the "photosensitive drum counter" data which are stored at three locations, respectively, the address shift amount is 25 between the first and second locations and 11 between the second and third locations. These address shift amounts are different from the address shift amount of 40 for the "detection of insertion" data and the "detection of new product" data which are stored at two locations respectively.

(f) Data to be stored at one location, namely, the data to be only read, such as the "destination" data and the "OEM code" data, and some of rewritable data, such as the "TC history" data and the "ATDC sensor off-set value" data, are stored at addresses prior to the second addresses of the same-content data which are stored at a plurality of locations. For example, the "destination" data, the "OEM code" data, the "TC history" data, and the "ATDC sensor off-set value" data are stored at addresses 2, 3, 21, and 22, respectively. These addresses 2, 3, 21, and 22 are smaller in number than the smallest-numbered second address 40 (second address of the "detection of insertion" data) of the same-content data which is stored at a plurality of addresses.

(g) The total number of addresses present between the adjacent locations at which data is stored is larger than the number of addresses used for storing other data given a number of locations different from the first mentioned data. This intends to dispose other data between adjacent locations of the first data.

Figure 10:
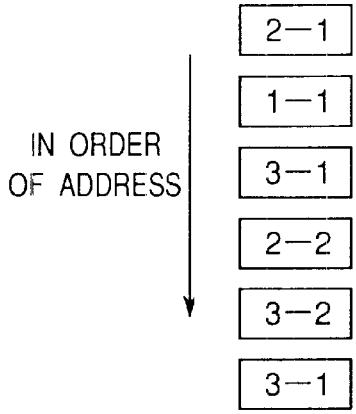
FIG. 10 illustrates an example of data arrangement in accordance with a rule.

FIG. 10 illustrates an example of data arrangement in accordance with the rules (d)–(g). The rectangular frames arranged vertically in FIG. 10 indicate data disposed in order of address. The numeral forward from the hyphen in each rectangular frame indicates the number of locations where the same data is stored. The numeral rearward from the hyphen in each rectangular frame indicates a serial number of the same data. For example, the indication "2-1" uppermost indicates that two locations are allocated to the data and that the data is stored at a first one of the two locations. The "1-1" next to the "2-1" indicates that a single location is allocated to the data and the data is stored at the single location. The indication "3-1" next to the "1-1" indicates that three locations are allocated to the data and that the data is stored at a first one of the three locations.

According to the rules (d)–(g), between the same-content data stored at a plurality of locations is disposed another data having a certain number of locations. Referring to the data arrangement shown in FIG. 10, data "1-1" and "3-1" are disposed between same-content data "2-1" and "2-2", and data "2-2" is disposed between same-content data "3-1" and "3-2". Accordingly, there is little possibility that the same-content data "2-1" and "2-2" are destroyed at the same time and that the same-content data "3-1" and "3-2" are destroyed at the same time.

Further, it is possible to enhance the storage efficiency of the EEPROM and place data efficiently in the EEPROM 20. For example, merely sixty-three words are required in the memory map shown in FIG. 8, whereas 127 words are required in a conventional memory map.

Furthermore, because the rules of arranging data in the EEPROM 20 are established, it is possible to simplify an access program for storing and reading data. Especially, according to the rule (f), even though the process cartridge 9 is set in a machine (e.g., an inspection machine which is used before shipment of the process cartridge 9 or after return thereof) in which the rules for data arrangement in the EEPROM 20 are not inputted, it is possible to read all data stored in the EEPROM 20 without reading the same data repeatedly before accessing a second location of same-content data stored at a plurality of places, by accessing addresses from the first address. Therefore, it is possible to simplify the control of the access to the EEPROM 20.

Figure 11A:
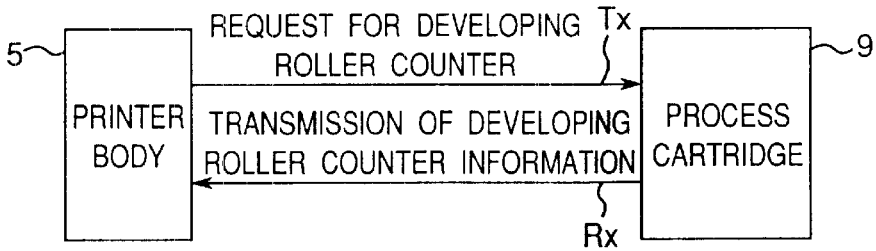
FIGS. 11A, 11B and 11C show data communications between the printer body and the process cartridge.
Figure 11B:
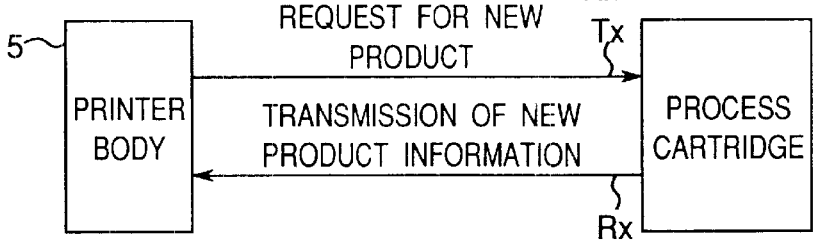
Figure 11C:
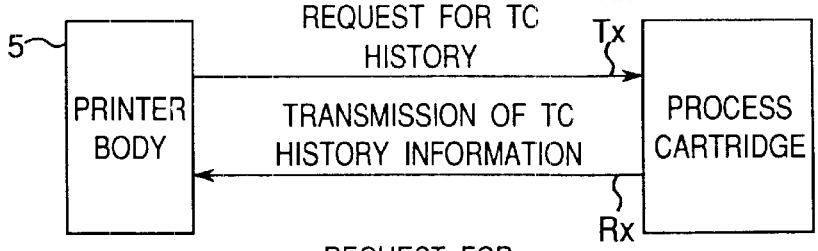
Figure 11D:
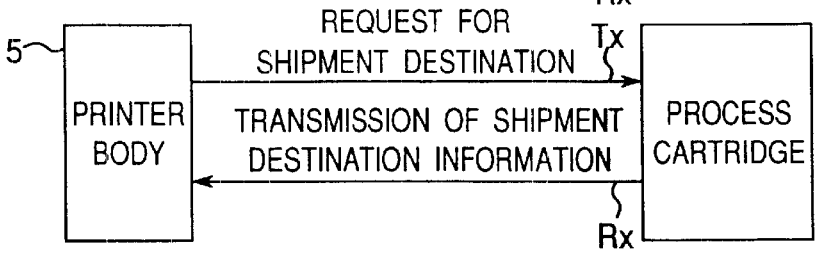

FIGS. 11A–11D exemplifies the modes of the data communication between the printer body 5 (more specifically, control board 26) and the process cartridge 9. FIG. 11A shows the communication of the "developing roller counter" data as an example of the rewritable data stored at three locations. FIG. 11B shows the communication of the "detection of new product" data as an example of the rewritable data stored at two locations. FIG. 11C shows the communication of the "TC history" data as an example of the rewritable data stored at one location. FIG. 11D shows the communication of the "shipment destination" data as an example of the read only data stored at only one location. In any of the above cases, the printer body 5 sends a control (request) signal to the process cartridge 9 through a serial bus transmission line Tx and receives an answer signal to the request signal from the process cartridge 9 through a serial bus receiving line Rx.

The detailed control procedure of the data communications (shown in FIGS. 11A–11D) will be described below, supposing that the memory map of the EEPROM 20 is as shown in FIG. 8.

Figure 12:
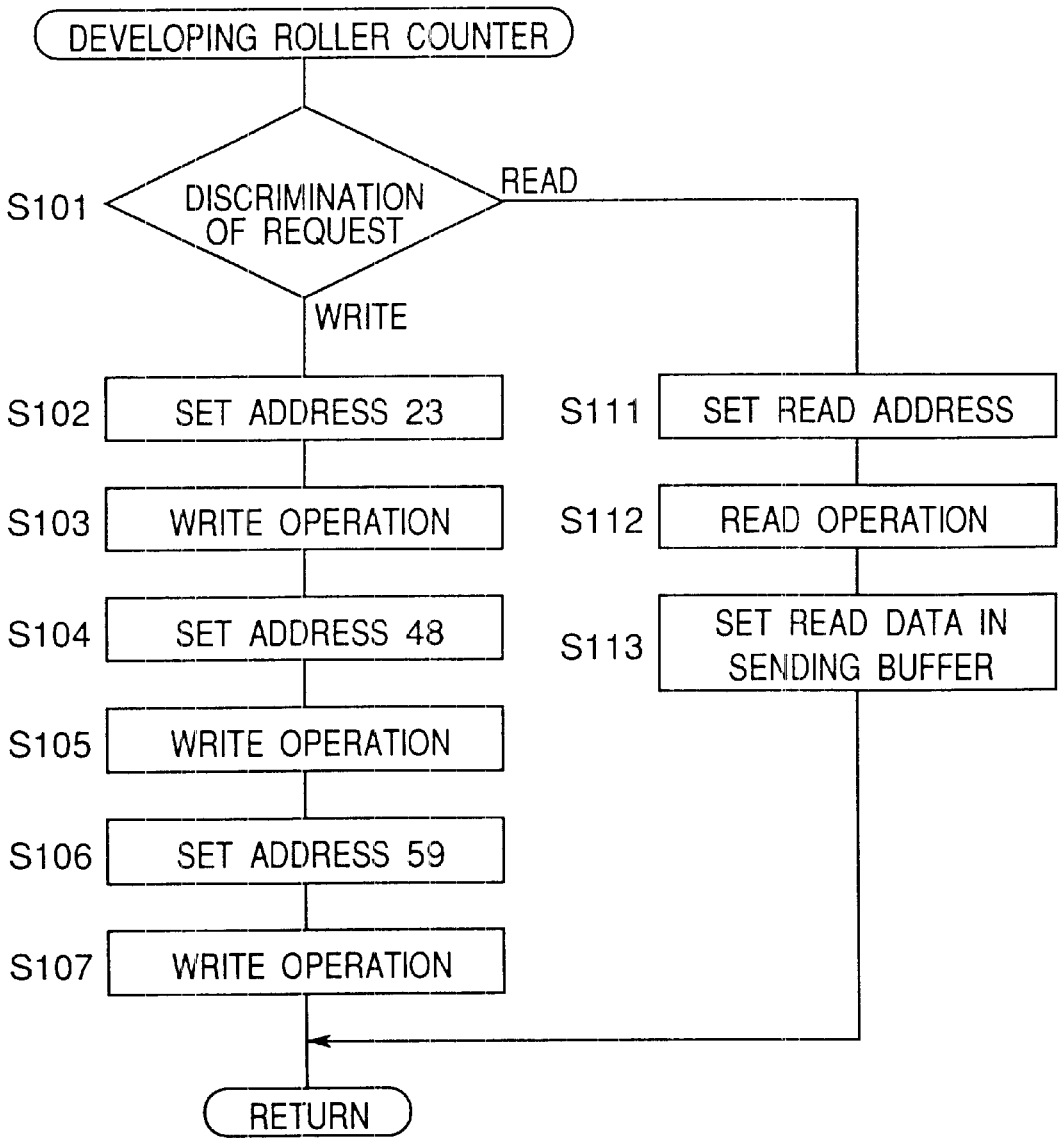
FIG. 12 shows a control flow regarding "developing roller counter" data.

Referring to FIG. 12, in the control of data communications for the "developing roller counter" data, it is determined at step 101 whether the received request is a "write" request or a "read" request. If the received request is the "write" request, a write address 23 for storing the "developing roller counter" data is set at step S102 to execute a write operation at step S103. At step S104, an address 48 obtained by adding the address shift amount of 25 to the address 23 is set as a write address to execute a write operation at step S105. Thereafter, at step S106, an address 59 obtained by adding the address shift amount of 11 to the address 48 is set as a write address to execute write operation at step S107. On the other hand, if it is discriminated at step S101 that the received request is the "read" request, a designated read address is set at step S111. At step S112, a consecutive read operation or a one-word read operation is executed to read the data at the designated read address. At step S113, the read data is set in a sending buffer (not shown) for sending the read data to the printer body 5. Then, the read data is sent from the process cartridge 9 to the printer body 5 through the serial bus transmission line Tx.

Figure 13:
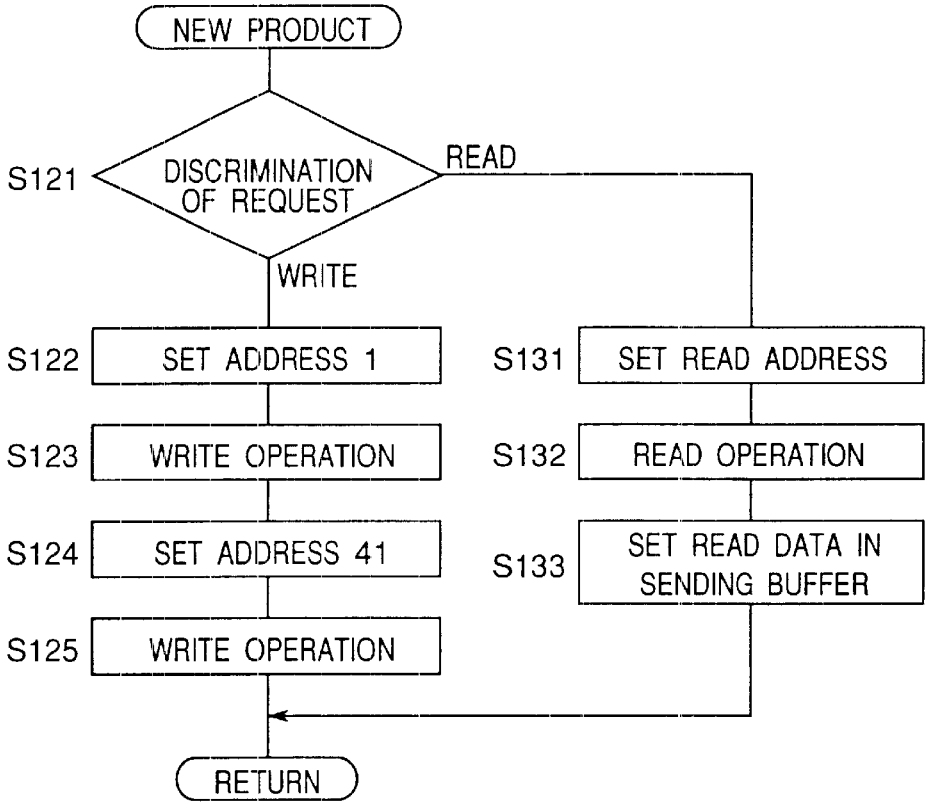
FIG. 13 shows a control flow regarding "detection of new product" data.

Referring to FIG. 13, in the control of data communications for the "detection of new product" data, it is discriminated at step 121 whether the content of a received request is a "write" request or a "read" request. If the received request is the "write" request, a write address 1 for storing the "detection of new product" data is set at step S122 to execute a write operation at step S123. At step S124, an address 41 obtained by adding the address shift amount of 40 to the address 1 is set as a write address to execute a write operation at step S125. On the other hand, if the received request is discriminated at step S121 to be the "read" request, then a designated read address is set at step S131.

At step S132, a consecutive read operation or a one-word read operation is executed to read the data of the designated read address. At step S133, the read data is set in the sending buffer (not shown) for sending the read data to the printer body 5. Then, the read data is sent from the process cartridge 9 to the printer body 5 through the serial bus transmission line Tx.

Figure 14:
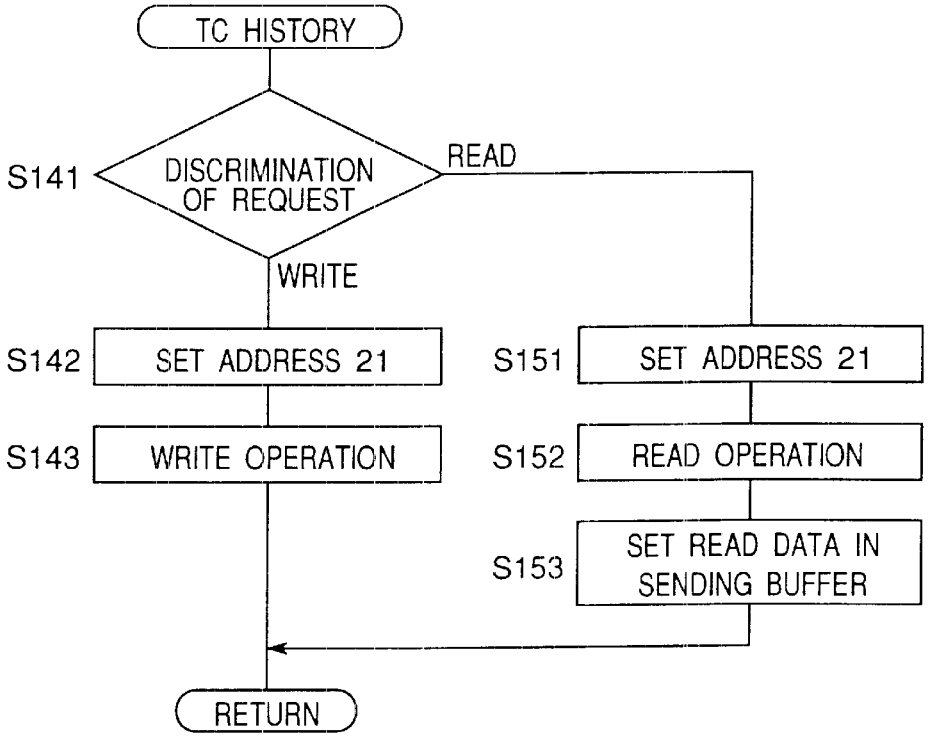
FIG. 14 shows a control flow regarding "TC history" data.

Referring to FIG. 14, in the control of data communications for the "TC history" data, it is discriminated at step 141 whether the content of a received request is a "write" request or a "read" request. If the received request is the "write" request, a write address 21 for storing the "TC history" data is set at step S142 to execute a write operation at step S143. On the other hand, if the received request at step S141 is the "read" request, then a designated read address (in this case, 21) is set at step S151. At step S152, the consecutive read operation or the one-word read operation is executed to read the data of the designated read address. At step S153, the read data is set in the sending buffer (not shown) for sending the read data to the printer body 5. Thus, the read data is sent from the process cartridge 9 to the printer body 5 through the serial bus transmission line Tx.

Figure 15:
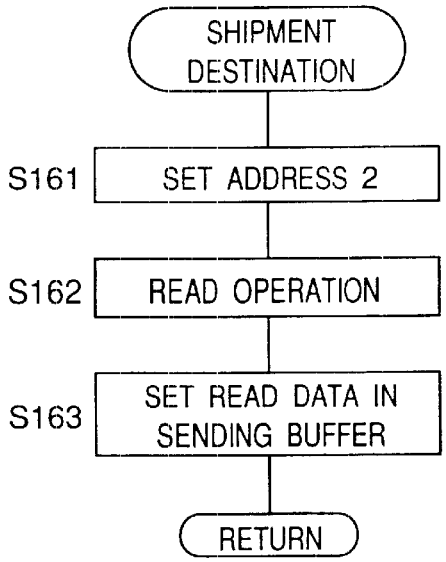
FIG. 15 shows a control flow regarding "destination" data.

Referring to FIG. 15, in the control of data communications for the "shipment destination" data, because the "shipment destination" data is a read only data, it is not determined whether the content of a received request is a "write" request or a "read" request. Thus as soon as a read request is received, a designated read address 2 is set at step S161. At step S162, the consecutive read operation or the one-word read operation is executed to read the data of the designated read address 2. At step S163, the read data is set in the sending buffer (not shown) for sending the read data to the printer body 5. The read data is sent from the process cartridge 9 to the printer body 5 through the serial bus transmission line Tx.

FIG. 16 shows another example of the memory map of the EEPROM 20 incorporated in each process cartridge 9. Similarly to the memory map shown in FIG. 8, read only data is not stored at a plurality of locations, but only at one location. On the other hand, rewritable data having the same content are stored at a plurality of locations spaced apart from each other, according to the number of accesses and a degree of importance thereof. Also, similar to the memory map of FIG. 8, if data is stored in consecutive addresses, such consecutive addresses are regarded as one location.

The memory map shown in FIG. 16 is characterized in that the "detection of insertion" data, the "shipment destination" data, the "OEM code" data, the "color code" data, and the "detection of new product" data are sequentially stored in this order from the headmost address 0 to address 4.

Figure 17:
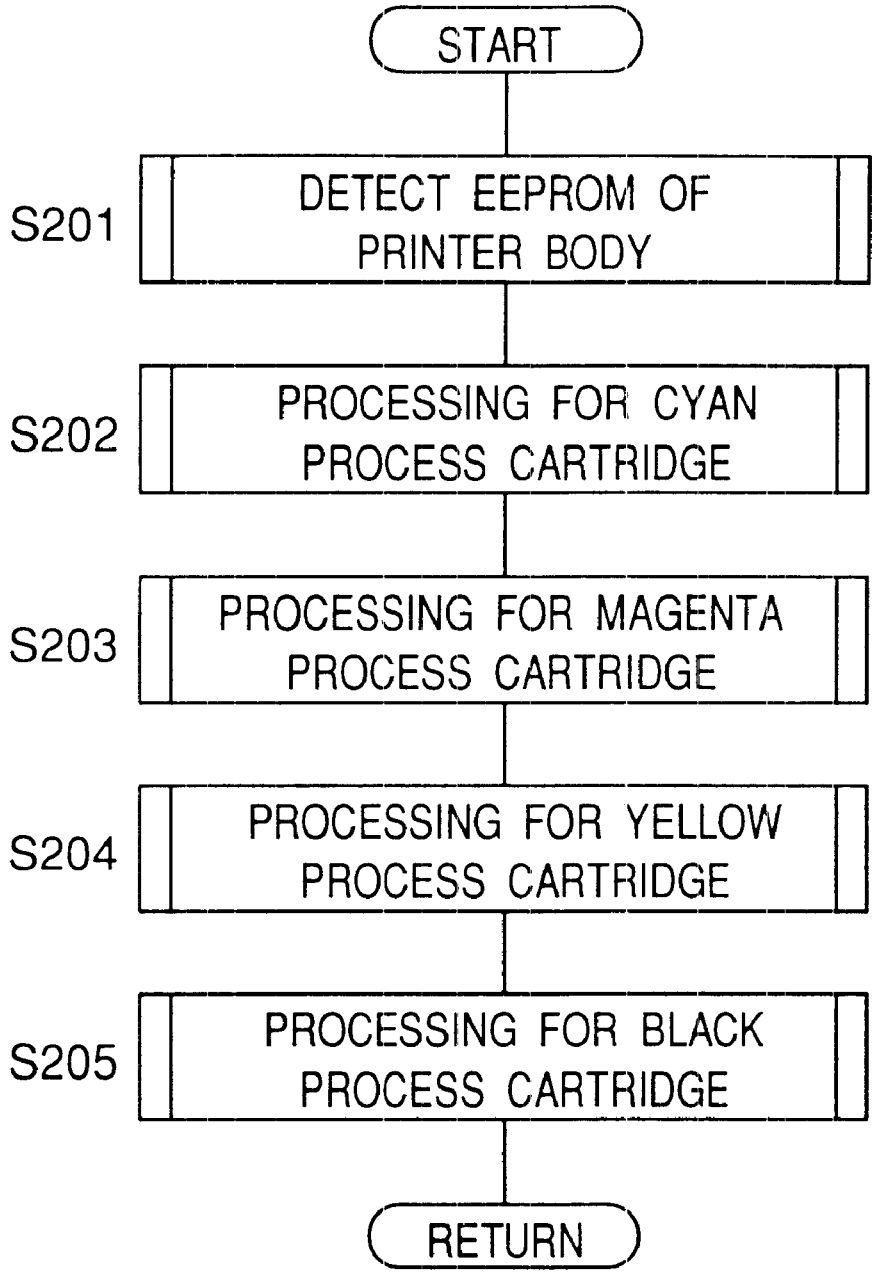
FIG. 17 shows a main routine of control over the EEPROMs of the process cartridges of different colors placed in the printer body.

FIG. 17 shows a main routine of processing to be executed by the CPU 27 (included in the control board 26 of the printer body 5) to detect whether the process cartridges 9Y, 9M, 9C, and 9K have been properly set or inserted in the printer body 5.

When the power supply is turned on, at step S201, the CPU 27 detects whether an EEPROM (which is a not-shown non-volatile memory different from the EEPROM 20) storing a program transfer processing procedure for the CPU 27 is present in the printer body 5. If the EEPROM is absent, it is determined that a trouble has occurred. Thus subsequent processing is not executed.

If the sensor SE16 shown in FIG. 3 detects that the front cover of the printer body 5 has been changed from its open state to its closed state when the EEPROM is present in the printer body 5, processings for the process cartridges 9Y, 9M, 9C, and 9K are performed at steps S202–S205.

Figure 18:
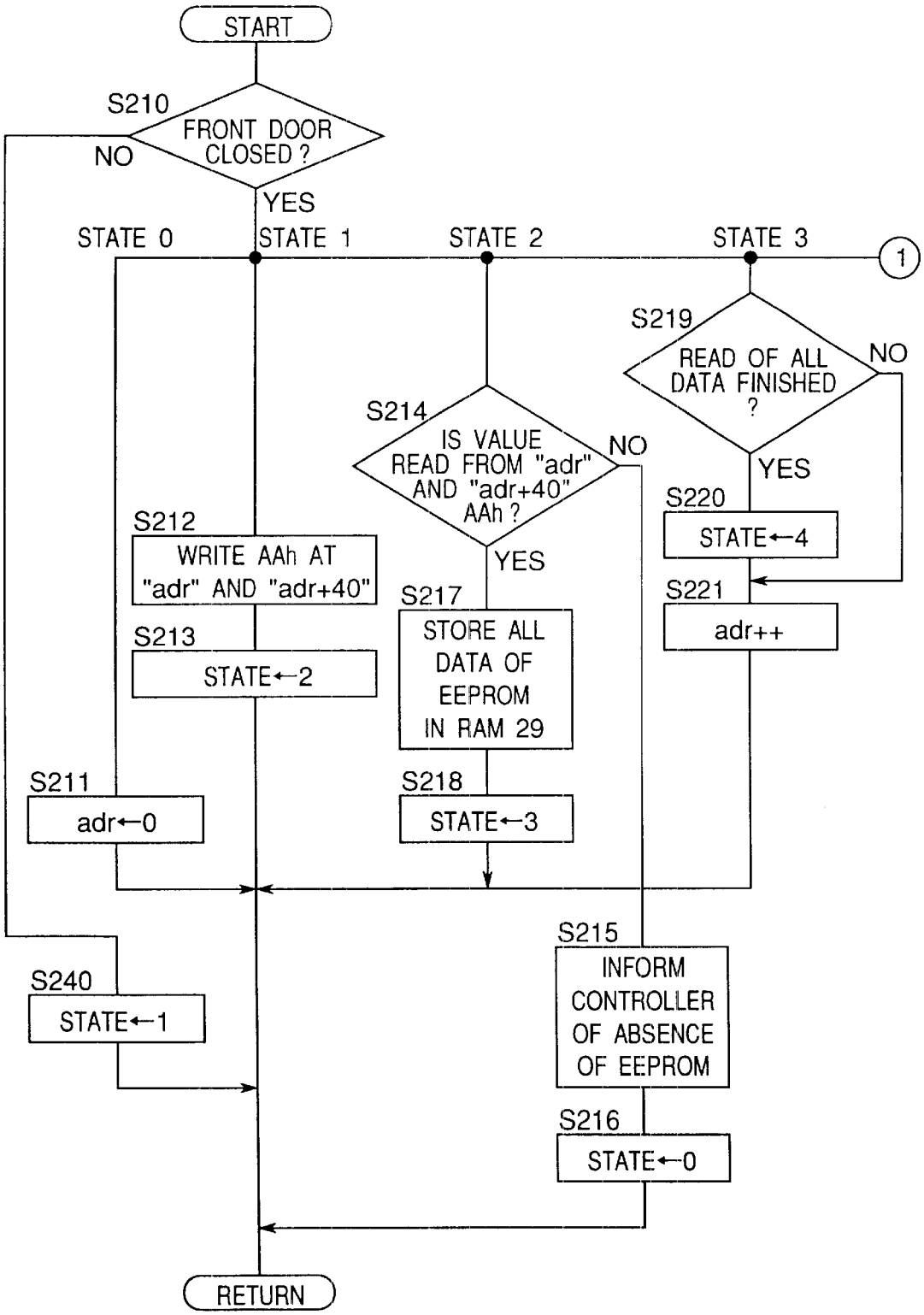
FIG. 18 shows a part of a detailed flow of control over the EEPROMs of the process cartridges of different colors.
Figure 19:
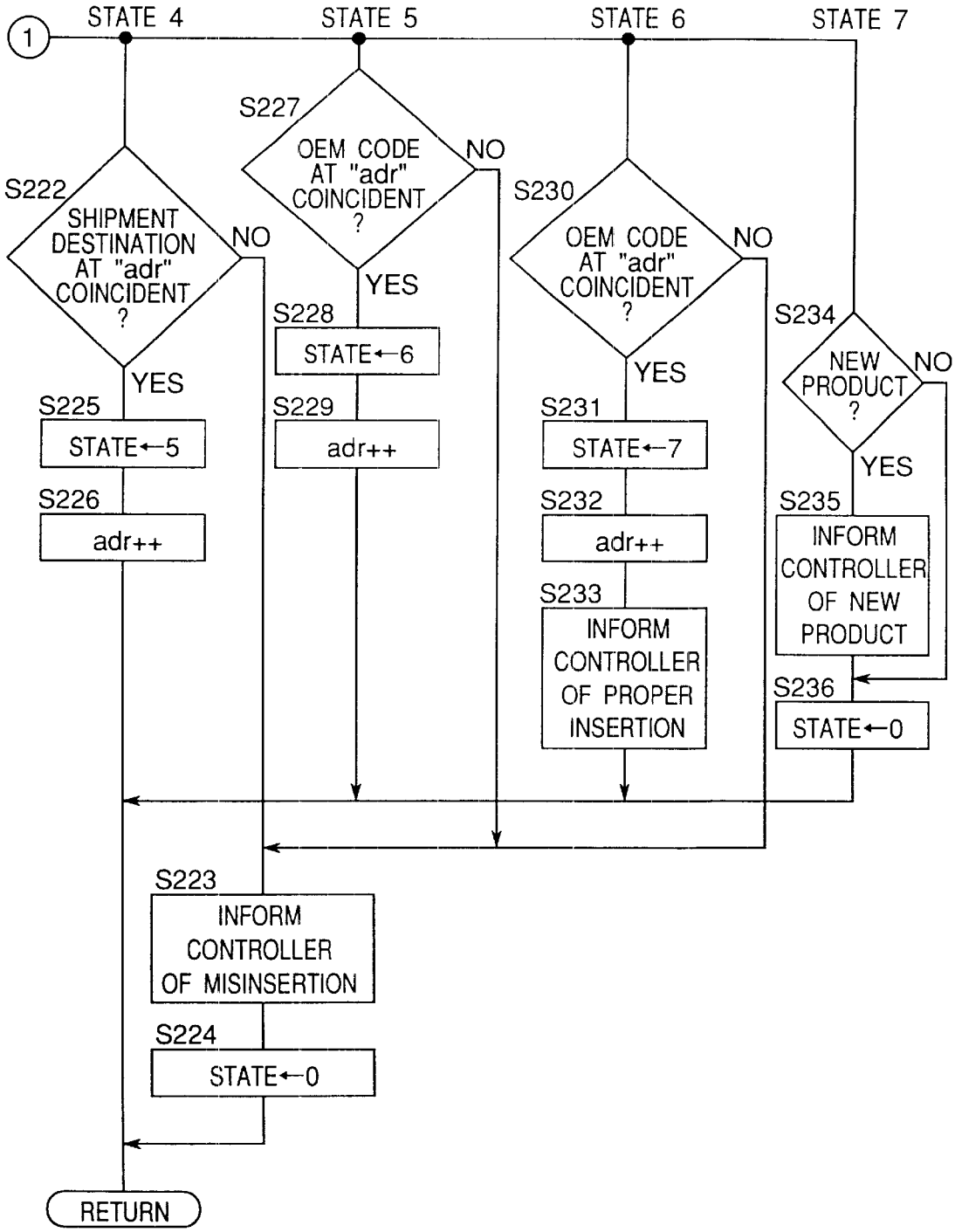
FIG. 19 shows a part of a detailed flow of the control over the EEPROMs of the process cartridges of different colors.

FIGS. 18 and 19 show the detailed flow of the processing (step S202–S205) for each of the process cartridges 9Y, 9M, 9C, and 9K. The processing shown by the flow is executed for the EEPROM 20 of each of the process cartridges 9Y, 9M, 9C, and 9K commonly and in parallel with each other, with the program repeating return to the main routine (hereinafter referred to as merely "return") shown in FIG. 17. At steps S211 to S221, the processing for the EEPROM of the printer body 5 is executed in parallel with the processing for the EEPROM 20 of each of the process cartridges 9Y, 9M, 9C, and 9K. But for convenience' sake, the processing to be executed for the EEPROM 20 of each of the process cartridges 9Y, 9M, 9C, and 9K will be described below.

Referring to FIG. 18, when it is determined at step S210 that the front cover of the printer body 5 is open, a variable "state" is set to 1 at step S240, and the program returns.

Once it is determined at step S210 that the front cover of the printer body 5 is closed, to access the first address in the EEPROM 20, a 0 is assigned to a variable "adr" indicating an address at step S211. Then the program returns.

At the next turn, data AAh is written to an address "adr" and an address "adr+40" at step S212. Then the variable "state" is set to 2 at step S213, and the program returns.

At the next turn, the data at address "adr" and that of the address "adr+40" are read to determine whether the read data is AAh at step 214. If neither the data read from the address "adr" nor the data read from the address "adr+40" is AAh, it is determined that the EEPROM 20 is absent in the printer body 5. Then at step S215, the CPU 27 informs the controller 25 that the EEPROM 20 (namely, process cartridge 9) is absent, or has not inserted, in the printer body 5. After the variable "state" is set to 0 at step S216, the program returns. When it is determined that the EEPROM 20 is absent in the printer body 5, no further processings toward this EEPROM 20 such as readout of the initial data and data writing are performed. If it is determined at step S214 that the at least one of data read from the address "adr" or the data read from the address "adr+40" is AAh, it is determined that the EEPROM 20 is present, or has been inserted, in the printer body 5. Then at step S217, the CPU 27 starts processing of successively reading all data stored in the EEPROM 20. All read data is stored in the RAM 29 of the control board 26. Then, after the variable "state" is set to 3 at step S218, the program returns.

If it is determined at step 219 that read of all data has not finished, the variable "adr" is incremented by one (indicated as "adr++" in the figure) at step S221. Then the program returns. On the other hand, if it is determined at step 219 that read of all data has finished, the variable "state" is set to 4 at step S220. After the variable "adr" is incremented at step S221, the program returns. In this manner, all data stored in the EEPROM 20 is stored in the RAM 29 of the control board 26.

At this time, the same address mapping as that of the EEPROM 20 is executed in the RAM 29. Thus, "data at the address xxx" mentioned below is equivalent to the data read from the same address xxx of the EEPROM 20.

Referring to FIG. 19, at the next turn, it is determined at step S222 whether the "shipment destination" data at address "adr" is coincident with "shipment destination" data read from the EEPROM of the printer body's own. Thereby whether the process cartridge 9 matches the printer body 5 is recognized. For example, if the shipment destination of the process cartridge 9 is Europe, whereas if the shipment destination of the printer body 5 is Japan, it is determined that the process cartridge 9 does not match the printer body 5. In such a case, the CPU 27 informs the controller 25 that the process cartridge 9 has been misinserted in the printer body 5 at step S223. Then, after the variable "state" is set to 0 at step S224, the program returns. When it is determined that the process cartridge 9 has been misinserted, namely, the process cartridge 9 is a wrong one, no access is made to the EEPROM 20 of this process cartridge 9 until a change from the open state to the closed state of the front cover of the printer body 5 is recognized. On the other hand, if it is determined at step S222 the "shipment destination" data at address "adr" and the "shipment destination" data of the printer body 5 are coincident with each other, the variable "state" is set to 5 at step S225. Then, after the variable "adr" is incremented at step S226, the program returns.

At the next turn, it is determined at step S227 whether the "OEM code" data at address "adr" and "OEM code" data read from the EEPROM of the printer body's own are coincident with each other. Whether the process cartridge 9 matches the printer body 5 is thereby recognized. If it is determined at step 227 that the "OEM code" data at address "adr" and the "OEM code" data of the printer body 5 are not coincident with each other, i.e., if it is determined that the process cartridge 9 does not match the printer body 5, the CPU 27 informs the controller 25 that this process cartridge 9 has been misinserted or misplaced in the printer body 5 at step S223, as in the processing executed at the previous turn. Then, after the variable "state" is set to 0 at step S224, the program returns. When it is determined that the process cartridge 9 has been misinserted in the printer body 5, no access is made for this EEPROM 20 of the process cartridge 9 until a change from the open state to the closed state of the front cover of the printer body 5 is recognized. If it is determined at step S227 that the "OEM code" data at address "adr" and the "OEM code" data of the printer body 5 are coincident with each other, the variable "state" is set to 6 at step S228. Then, the variable "adr" is incremented at step S229, and the program returns.

At the next turn, it is determined at step S230 whether the "color code" data at address "adr" and the "color code" data of the cartridge-inserted position (the station of yellow, magenta, cyan or black) of the printer body 5 are coincident with each other. The color code 1 corresponds to cyan (C), 2 corresponds to magenta (M), 4 corresponds to yellow (Y), and 8 corresponds to black (K). For example, if the "color code" data at address "adr" is 1 indicating cyan (C), but if the "color code" data of the cartridge-inserted position of the printer body 5 is 2 indicating magenta (M), it can be determined that the process cartridge 9 is not placed in the right position of the printer body 5. That is, if it is determined that the "color code" data at address "adr" and the "color code" data of the cartridge-inserted position of the printer body 5 are not coincident with each other, and therefore, that the process cartridge 9 is not placed in the right position of the printer body 5, then at step S223 the CPU 27 informs the controller 25 that the process cartridge 9 has been misinserted in the printer body 5. Then, after the variable "state" is set to 0 at step S224, the program returns. When it is determined that the process cartridge 9 has been misinserted, no access is made for the EEPROM 20 of the process cartridge 9 until a change from the open state to the closed state of the front cover of the printer body 5 is recognized. On the other hand, if it is determined at step S230 that the "color code" data at address "adr" and the "color code" data of the cartridge-inserted position of the printer body 5 are coincident with each other, i.e., it is determined that the process cartridge 9 is placed in the correct position, then it can be determined for the first time that the process cartridge 9 has been inserted, or set, properly. Thus, the variable "state" is set to 7 at step S231 and the variable "adr" is incremented at step S232, and then at step S233 the CPU 27 informs the controller 25 that the process cartridge 9 has been inserted properly. Then the program returns. When it is determined that the process cartridge 9 has been properly set, access to the EEPROM 20 of this process cartridge 9 is allowed until the front cover of the printer body 5 opens. Accordingly, the controller 25 of the printer body 5 is now capable of starting controls for forming images by using the process cartridge 9.

For example, at the next turn, the "detection of new product" data indicating whether the process cartridge 9 is new is read at step S234 to determine whether the process cartridge 9 is new. If the value of the "detection of new product" is neither 4Bh nor FFFFh, the process cartridge 9 is not new, whereas if the value of the "detection of new product" is 4Bh or FFFFh, the process cartridge 9 is new. If the process cartridge 9 is not new, the variable "state" is set to 0 at step S236. Then the program returns. On the other hand, if the process cartridge 9 is new, the CPU 27 informs the controller 25 that the process cartridge 9 is new. Then, after the variable "state "is set to 0 at step S236, the program returns. This allows the density adjustment of the process cartridge 9 to be completed before other controls for image formation are executed. Thus the color of the process cartridge 9 can be balanced with the colors of the other process cartridges 9.

As understood from the above, by executing simple controls, the CPU 27 can determine whether the process cartridge 9 has been properly inserted in the printer body. This is because according to the present invention, the EEPROM 20 of the process cartridge 9 sequentially contains the "detection of insertion" data at the headmost address 0, the "shipment destination" data as a destination data at the next address 1, the "OEM code" data also as a destination data at the next address 2, and the "color code" data at the next address 3. That is, due to the memory mapping of the EEPROM 20 of the process cartridge 9 shown in FIG. 16, it is possible to obtain information required to check whether the process cartridge 9 has been properly set in the printer body 5 just by incrementing the variable adr from the first address of the EEPROM 20 of the process cartridge 9 and even without use of a table containing information about the order in which the addresses of the EEPROM 20 are to be accessed. Therefore, it is unnecessary to prepare such a table.

Further, when the process cartridge 9 is mounted on an inspection machine which is used before shipment of the process cartridge 9 and/or after retrieval or recovery thereof, the control system of the inspection machine is allowed to access the EEPROM 20 of the process cartridge 9 sequentially from the first address. That is, the inspection machine can inspect the process cartridge 9 without use of a table containing information about the order in which the addresses of the EEPROM 20 are to be accessed. Therefore, it is unnecessary to prepare such a table.

Figure 20:
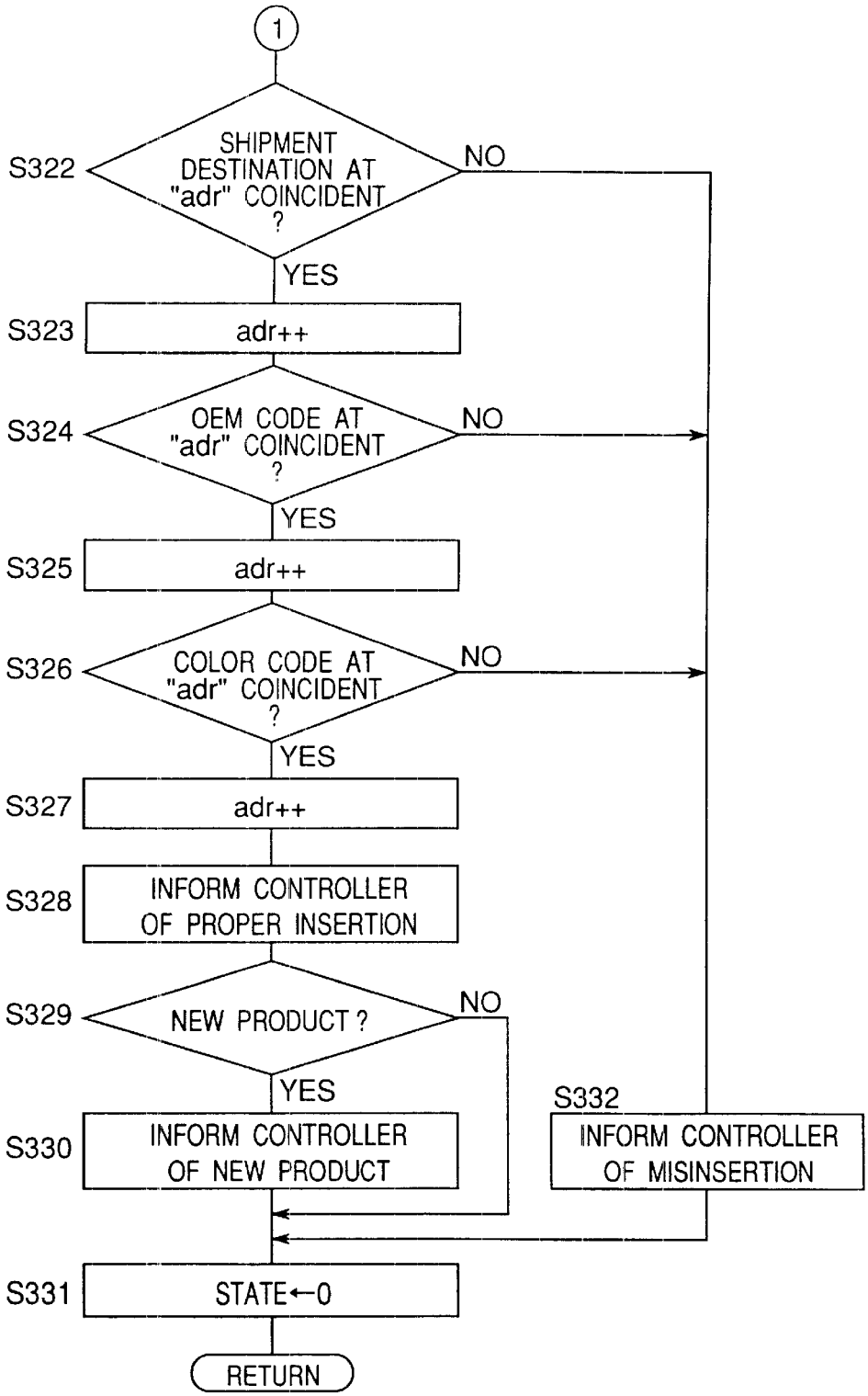
FIG. 20 shows an alternative to the flow of control over the EEPROMs of the process cartridges of different colors shown in FIG. 19.

FIG. 20 shows an alternative to the detailed flow shown in FIG. 19 of the processings for the process cartridges 9Y, 9M, 9C, and 9K (to be performed at steps S202–S205 in FIG. 17). The processings from step S210 to step S221 shown in FIG. 18 are executed in this example as well. Namely, the processings from the detection of the state change of the front cover of the printer body 5 from the open state to the closed state to the storage of all data of the EEPROM 20 in the RAM 29 of the control board 26 are still performed in combination with the steps of FIG. 20.

Referring now to FIG. 2*o*, after all data has been read, it is determined at step S322 whether the "shipment destination" data at address "adr" and the "shipment destination" data read from the EEPROM of the printer body 5 are coincident with each other. Whether the process cartridge 9 matches the printer body 5 is thereby recognized. If it is determined at step S322 that the "shipment destination" data at address "adr" and the "shipment destination" data of the printer body 5 are coincident with each other, the variable "adr" is incremented at step S323.

Subsequently, it is determined at step S324 whether the "OEM code" data at address "adr" and the "OEM code" data read from the EEPROM of the printer body 5 are coincident with each other. Whether the process cartridge 9 matches the printer body 5 is thereby recognized. If it is determined at step S324 that the "OEM code" data at address "adr" and the "OEM code" data of the printer body 5 are coincident with each other, it is determined that the process cartridge 9 matches the printer body 5. Then the variable "adr" is incremented at step S325.

Then it is determined at step S326 whether the color code" data at address "adr" and the "color code" data of the cartridge-inserted position (namely, the station of yellow, magenta, cyan or black) of the printer body 5 are coincident with each other. If it is determined that the "color code" data at address "adr" and "color code" data of the cartridge-inserted position of the printer body 5 are coincident with each other, and therefore that the process cartridge 9 is placed in the correct position, then it is determined that the process cartridge 9 has been inserted properly. Thus, the variable "adr" is incremented at step S327 and then at step S328, the CPU 27 informs the controller 25 that the process cartridge 9 has been inserted properly. Then the program returns. Once it is determined that the process cartridge 9 has been properly inserted, access to data of the EEPROM 20 of the process cartridge 9 is allowed until the front cover of the printer body 5 opens. Accordingly, the controller 25 of the printer body 5 is capable of starting various control operations for imaging using the process cartridge 9.

For example, the "detection of new product" data indicating whether the process cartridge 9 is new is read at step S329 to determine whether the process cartridge 9 is new. If the process cartridge 9 is not new, the variable "state" is set to 0 at step S331. Then the program returns. On the other hand, if the process cartridge 9 is new, the CPU 27 informs the controller 25 that this process cartridge 9 is new at step S330. This allows necessary density adjustment of the process cartridge 9 to be completed before other controls for image formation are made. Thus the color of the process cartridge 9 can be balanced with colors of the other process cartridges 9Y, 9M, 9C, and 9K.

On the other hand, if it is determined at step S322 that the "shipment destination" data at address "adr" and the shipment destination" data of the printer body 5 are not coincident with each other, and accordingly that the process cartridge 9 does not match the printer body 5, the CPU 27 informs the controller 25 that this process cartridge 9 has been misinserted in the printer body 5 at step S332. Similarly, if it is determined at step S324 that the "OEM code" data at address "adr" and the "OEM code" data of the printer body 5 are not coincident with each other and accordingly that the process cartridge 9 does not match the printer body 5, the CPU 27 informs the controller 25 that this process cartridge 9 has been misinserted in the printer body 5 at step S332, as in the previous turn. Similarly, if it is determined at step S326 that the "color code" data at address "adr" and the "color code" data of the cartridge-inserted position of the printer body 5 are not coincident with each other and accordingly that the process cartridge 9 is not placed in the right position, the CPU 27 informs the controller 25 that the process cartridge 9 has been misinserted in the printer body 5 at step S332. When the CPU 27 informs the controller 25 that the process cartridge 9 has been misinserted in the printer body 5, the variable "state" is set to 0 at step S331, and the program returns. When it is determined that the process cartridge 9 has been misinserted, no further access to the data of the EEPROM 20 of the process cartridge 9 is made until a change from the open state to the closed state of the front cover of the printer body 5 is recognized.

In this example having the flow of FIG. 26 as well, the CPU 27 can determine whether the process cartridge 9 has been properly inserted, or set, in the printer body 5 by executing simple control, as in the previous example. Furthermore, the flow of the FIG. 20 example needs fewer steps before determining the proper insertion of the process cartridge 9 than the flow of the FIG. 19 example. Thus, such determination can be made more quickly.

In the described embodiment, the process cartridge 9 has the photosensitive drum 111, the charging unit 101, the exposing unit 102, the developing unit 103, the cleaner 116, and the toner reservoir as the constituent elements serving as the means for forming an image, in addition to the EEPROM 20 serving as the non-volatile memory. But the process cartridge of the present invention is not limited to the mode. It should be understood that any process cartridge is included in the scope of the present invention, provided that it has any one of the constituent elements serving as the means for forming an image. For example, the exposing unit for exposing the surface of the photosensitive drum maybe fixedly installed in a housing of the printer body. In this case, the photosensitive drum, the charging unit, and the cleaner may be integrated together as a photosensitive unit and the developing unit and the toner reservoir may be integrated together as a developing unit. Such unitization of the constituent elements makes it easy to produce the process cartridge.

Also, it should be understood that a process cartridge having only the non-volatile memory and the toner reservoir is included in the scope of the present invention. In using such a process cartridge, the remaining constituent elements, namely, the photosensitive drum, the charging unit, the exposing unit, the developing unit, and the cleaner may be fixed to the printer body. Alternatively, the above remaining constituent elements may be constructed as a cartridge which is removably set in the printer body.

Furthermore, in the described embodiment, the process cartridge 9 contains the EEPROM 20 as an example of a non-volatile memory. But the process cartridge of the present invention may have a non-volatile memory other than the EEPROM. Also, the non-volatile memory does not necessarily have to be contained in a housing of the process cartridge but may be attached to an outer surface of the housing of the process cartridge through a socket provided on the outer surface thereof.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process cartridge removably insertable in a body of an image-forming apparatus, comprising:

a constituent element executing an image formation process; and a non-volatile memory storing rewritable data having an identical content at a plurality of mutually spaced locations, and each of read-only data at locations equal in number to or fewer than the locations for a rewritable data which is assigned a fewest number of locations among all the rewritable data.

2. A process cartridge according to claim 1, wherein said rewritable data includes a counter data that represents a value counted when an image formation process is performed using the process cartridge.

3. A process cartridge according to claim 2, wherein said rewritable data further includes a detection-of insertion data indicating whether the process cartridge has been inserted in the body of the image-forming apparatus.

4. A process cartridge according to claim 3, wherein the number of locations in the non-volatile memory for the detection-of-insertion data are smaller than that for the counter data.

5. A process cartridge according to claim 2, wherein said rewritable data further includes a detection-of-new-product data indicating whether the process cartridge is new.

6. A process cartridge according to claim 5, wherein the number of locations in the non-volatile memory for the detection-of-new-product data is smaller than that for the counter data.

7. A process cartridge according to claim 1, wherein said read only data includes data indicating a kind of the process cartridge.

8. A process cartridge removably insertable in a body of an image-forming apparatus, comprising:

a constituent element executing an image formation process; and a non-volatile memory storing data having an identical content at a plurality of mutually spaced locations in address shift amounts set according to a kind of the data.

9. A process cartridge according to claim 8, wherein the address shift amounts are different among a plurality of data that are assigned a different number of locations in the non-volatile memory, and the address shift amounts are the same among a plurality of data that are assigned the same number of locations in the non-volatile memory.

10. A process cartridge according to claim 8, wherein in the non-volatile memory, data assigned a single location is stored at an address prior to an address of a second one of the locations for the data having an identical content.

11. A process cartridge removably insertable in a body of an image-forming apparatus, comprising:

at least one constituent element executing an image formation process; and a non-volatile memory sequentially storing, from a head-most address thereof, a detection-of-insertion data indicating whether the process cartridge has been inserted in the body of the image-forming apparatus, a destination data indicating a destination of the process cartridge, and a color code data indicating a color of an image which is formed by the process cartridge.

12. A process cartridge according to claim 11, wherein the destination data includes, in order of address, a shipment destination data indicating a destination classified by region and an OEM code data indicating an OEM for which the process cartridge has been manufactured.

13. A process cartridge according to claim 11, wherein the non-volatile memory contains a detection-of-new-product data indicating whether the process cartridge is new at an address subsequent to the address at which the color code data is stored.

14. A process cartridge according to claim 11, wherein said at least one constituent element includes a photosensitive unit including a photosensitive drum, a charging device, and a cleaner, and a developing unit including a developing device and a toner reservoir.

* * * * *